US006537473B2

(12) United States Patent
Raetzsch et al.

(10) Patent No.: US 6,537,473 B2
(45) Date of Patent: Mar. 25, 2003

(54) PROCESS OF MAKING POLYOLEFIN FIBERS

(75) Inventors: Manfred Raetzsch, Kirchschlag (AT); Ulf Panzer, Perg (AT); Achim Hesse, Linz (AT); Norbert Reichelt, Neuhofen (AT); Manfred Kirchberger, Prambachkirchen (AT); Peter Niedersuess, Linz (AT); Anton Wolfsberger, Engerwitzdorf (AT)

(73) Assignee: Borealis GmbH, Schwechat-Mannswoerth (AT)

( * ) Notice: Subject to any disclaimer, the term of this patent is extended or adjusted under 35 U.S.C. 154(b) by 220 days.

(21) Appl. No.: 09/733,886

(22) Filed: Dec. 8, 2000

(65) Prior Publication Data

US 2002/0002241 A1 Jan. 3, 2002

Related U.S. Application Data

(62) Division of application No. 09/069,689, filed on Apr. 29, 1998, now Pat. No. 6,218,011.

(30) Foreign Application Priority Data

May 14, 1997 (DE) ..... 197 20 135

May 30, 1997 (DE) ..... 197 22 579

(51) Int. Cl.[7] ..... D01D 5/26; D01F 6/42; D02G 1/00; D02G 3/02

(52) U.S. Cl. ..... 264/103; 28/271; 264/140; 264/143; 264/168; 264/211.12; 264/211.14; 264/211.24

(58) Field of Search ..... 264/103, 140, 264/143, 168, 211.12, 211.14, 211.24; 28/271

(56) References Cited

FOREIGN PATENT DOCUMENTS

| | | | |
|---|---|---|---|
| EP | 0138224 A2 | * | 4/1985 |
| JP | 10001823 A | * | 1/1998 |

* cited by examiner

*Primary Examiner*—Leo B. Tentoni
(74) *Attorney, Agent, or Firm*—Jordan and Hamburg LLP

(57) ABSTRACT

Polyolefin fibers and polyolefin yarns of high strength and elongation and textile fabrics produced therefrom, which consist of modified propylene polymers, unmodified propylene polymers and adjuvants, are produced by melting the polyolefin mixtures in the extruder, transferring the melt by extrusion pumps to the spinnerets and drawing off the extruded filaments by high-speed galettes and/or winders.

4 Claims, 1 Drawing Sheet

PROCESS OF MAKING POLYOLEFIN FIBERS

This is a division, of application Ser. No. 09/069,689, filed Apr. 29, 1998, now U.S. Pat. No. 6,218,011.

BACKGROUND OF THE INVENTION

The invention relates to polyolefin fibers and polyolefin yarns, produced by melt processing and having high strength and elongation, particularly polyolefin fibers and yarns, which have not been afterstretched, and to textile fabrics produced therefrom.

Fibers, yarns and textile fabrics of polypropylene are known (U.S. Pat. No. 3,092,891; "Films, Woven and Nonwoven materials of Polypropylene", pages 175–189, VDI-Verlag, Düsseldorf, 1979; Moore, P., "Polypropylene-Handbook", pages 350–358, Carl-Hanser Verlag, Munich, 1996).

The methods of manufacturing fibers and yarns based on polypropylene differ depending on the spinning speed and on the aftertreatment of the spun fibers.

The high-speed spinning method and the abbreviated spinning method are known methods of manufacturing polypropylene staple fibers by melt spinning.

For the production of staple fibers based on polypropylene by the high-speed spinning method, already known as the high-speed spinning process for extruding polyester or polyamide filaments, the latter are drawn off at high speed (500 to 2000 m/min.) from the spinneret. Since the polypropylene macromolecules are not oriented completely by this method, the filaments produced must be drawn in a further step of the procedure. This is generally done in combination with other finishing steps.

The production of staple fibers based on polypropylene by the abbreviated spinning method is carried out at very low spinning speeds (30 to 150 m/min). As a result, the cooling zones of the spinning plants can be kept very short (Schweitzer, A., Chemiefasern/Textilindustrie 88 (1986), 671–674). The low spinning speeds enable the filaments, which are brought together to form tow, to be supplied directly and continuously to the drawing equipment and to the equipment further downstream.

The technology of high-speed spinning also results in POY (pre-oriented yarn) spinning, in which the filament, emerging from the spinneret, passes through the blast shaft of high-speed galettes or is drawn off directly by the winding machine at 1000 to 5000 m/min and wound onto cross-wound bobbins. The fiber properties are determined largely by the orientation introduced from the molten state (Wulfhorst, B., Chemiefasern/Textilindustrie 92 (1990), 971–976). This orientation effect results from the difference between the extrusion speed and the pull-off and winding speed.

Comparable relationships for effecting fiber properties exist also for the spunbonded nonwoven method. For the latter, the filaments are drawn off through the cooling zone either through accelerated downpipe air or through nozzles operated by compressed air (Fourné, F., Chemiefasern/Textilindustrie 95 (1993), 811–822). The undrawn filaments produced are deposited in two-dimensional disordered form on a screen-like conveyor belt and processed in a further step by the application of thermal bonding processes (by means of calender consolidation) or by needling processes into a spunbonded nonwoven material.

The melt-blow spinning technology, in which filaments are formed by the application of a heated stream of air about the openings of the capillary nozzle (Fourné, F., Chemiefasern/Textilindustrie 81 (1979), 445–449) represents a special variation of the nonwoven manufacturing process. The air stream divides the molten polymer filament into many small individual fibrils with a very small diameter and, at the same time, brings about a stretching of the individual filaments. The fibers or filaments, deposited on the screen conveyor belt, are processed further by the spunbonded nonwoven technology.

For the production of high strength filaments yarns (fully drawn yarn (FDY)), the filaments are drawn with the help of galettes from the spinneret and processed further in downstream equipment, comprising drawing equipment and winding machines. High strength filaments yarns can be produced by the abbreviated spinning method as well as the high-speed spinning method. In addition, for the bulked continuous filament method, drawing is accomplished by a three-dimensional crimping by texturing equipment (Bussmann, M., Chemiefasern/Textilindustrie 35 (1986) 87, 668–672).

The properties of the fibers, yarns and textile fabrics are determined by the manufacturing method and by the polypropylenes used.

The addition of nucleating agents leads to a lowering of the strength of the fibers (Richeson, G., ANTEC '96, 2305–2311). Formulations with fillers, such as calcium carbonate (Nago., S., J. Appl. Polymer Sci. 62 (1996), 81–86) or poly(methylsesquioxane) (Nago., S., J. Appl. Polymer Sci. 61 (1996), 2355–2359), after spinning and drawing, result in microporous fibers. Fibers of increased heat stability can be produced by spinning polypropylene blended polyethylene terephthalate (Qin, Y., J. Appl. Polymer Sci. 61 (1966), 1287–1292) or with liquid crystalline polymers (Qin, Y., Polymer 34 (1963), 3597).

Fibers of polypropylene have the disadvantage of a relatively low tensile elongation. The addition of elastomers, such as ethylene propylene rubber or ethylene propylene diene rubber leads to an increase in the elongation. At the same time, however, there is a great decrease in the strength of the polypropylene fibers and polypropylene yarns.

It is an object of the present invention to develop polyolefin fibers and polyolefin yarns of high strength and elongation, particularly polyolefin fibers and yarns, which have not been afterstretched, and textile fabrics produced therefrom.

SUMMARY OF THE INVENTION

Pursuant to the invention, this objective was accomplished by polyolefin fibers and polyolefin yarns of high strength and elongation, produced by melt processing, particularly polyolefin fibers and polyolefin yarns, which have not been afterstretched and have capillary titers of 1 to 10 dtex and tensile elongations in excess of 130% and tensile strengths of at least 15 cN/tex, and by textile fabrics produced therefrom, the polyolefin fibers and polyolefin yarns and the textile fabrics produced therefrom, pursuant to the invention, consisting either of polypropylene mixtures which are produced, on the one hand, from A) 0.05% to 10% by weight and preferably 0.2% to 3% by weight of modified polypropylene polymers with melt indexes of 0.1 to 50 g/10 min at 230° C./2.16 kg and preferably of 1 to 40 g/10 min at 230° C./2.16 kg and a ratio of the intrinsic viscosity of the modified polypropylene to the intrinsic viscosity of the unmodified polypropylene with largely the same weight average molecular weights of 0.20 to 0.95, a) by treatment of propylene homopolymers and/or copolymers of propylene and ethylene or of α-olefins with 4 to 18 carbon atoms as well as of mixtures of said polypropylenes with multifunctional, ethylenically unsaturated monomers in the presence of ionizing radiation or of thermally decomposing free radical-forming agents, or b) by reaction of functionalized polypropylenes, preferably of acid group- and/or acid anhydride group-containing polypropylenes, with multifunctional compounds of opposite reactivity, preferably with $C_2$ to $C_{16}$ diamines and/or $C_2$ to $C_{16}$ diols, c) by hydrolytic condensation of polypropylenes, which contain hydrolyzable silane groups, and, on the other hand, from B) 99.95% to 90% by weight and preferably 99.8% to 97% by weight of unmodified propylene polymers, the unmodified propylene polymers consisting of 1) conventional propylene polymers, propylene homopolymers and/or copolymers of propylene, ethylene and/or α-olefins with 4 to 18 carbon atoms, preferably synthesized using Ziegler-Natta catalysts or metallocene catalysts, with a propylene content of 80.0% to 99.9% by weight in the form of random copolymers, block copolymers and/or random block copolymers with melt indexes of 0.1 to 300 g/10 minutes at 230° C./16 kg and preferably of 1 to 100 g/10 min at 230°/2.16 kg, which may be contained in the polyolefin fibers and polyolefin yarns and the textile fabrics produced therefrom in amounts up to 99% by weight and preferably of 50% to 99% by weight, and/or 2) a polyolefin mixture with an $M_w/M_n$ ratio of 2 to 6 and a melt index of 1 to 40 g/10 min at 230° C./2.16 kg, which consists of 2.1) 60% to 98% by weight of a crystalline polymer of 85% to 99.5% by weight of propylene and 15% to 0.5% by weight of ethylene and/or an α-olefin of the general formula $CH_2{=}CHR$, in which R is a linear or branched alkyl group with 2 to 8 carbon atoms, 2.2) 2% to 40% by weight of an elastic copolymer of 20% to 70% by weight of ethylene and 80% to 30% by weight of propylene and/or an α-olefin of the general formula $CH_2{=}CHR$, in which R is a linear or branched alkyl group with 2 to 8 carbon atoms, the polyolefin mixture being contained in polyolefin fibers and polyolefin yarns and the textile fabrics produced therefrom in an amount of up to 99% by weight and preferably of 10% to 80% by weight, 3) largely amorphous polypropylenes or propylene copolymers containing crystalline polypropylene or crystalline propylene copolymer in an amount of less than 10% by weight, a latent heat of fusion of less than 40 J/g and a melt index of 0.1 to 100 g/10 min at 230° C./2.16 kg, the largely amorphous polypropylene being a homopolymer of propylene and/or a copolymer of propylene of at least 80 mole percent propylene and at most 20 mole percent of one or more α-olefins of the general formula $CH_2{=}CHR$, in which R is a linear or branched alkyl group with 2 to 8 carbon atoms, which may be contained in the polyolefin fibers and polyolefin yarns and in the textile fabric produced therefrom in an amount up to 50% by weight, and/or 4) non-isotactic polypropylene homopolymers with a melting point of 145° to 165° C. and a melt viscosity in excess of 200,000 cps at 190° C., a heat of crystallization of 4 to 10 cal/g and a diethyl ether-soluble portion of 35% by weight to 55% by weight, which may be contained in the polyolefin fibers and the polyolefin yarns and in the textile fabric produced therefrom in an amount up to 50% by weight, or only of unmodified propylene polymers B), components 3) and/or 4) being contained in amounts of 5% to 50% by weight and the remaining components being contained in the mixture in an amount of 95% to 50% by weight, and, furthermore, 0.01% to 5% by weight of adjuvants, based on the polyolefins being contained in the polyolefin fibers and the polyolefin yarns and the textile fabrics produced therefrom.

The modified propylene polymers A), optionally contained in the polyolefin fibers and polyolefin yarns of high strength and elongation and the textile fabrics produced therefrom, are propylene polymers, which were synthesized by the free radical coupling reactions or polymer-like reactions of functionalized polypropylenes.

The starting materials for the modified propylene polymers A) preferably are propylene homopolymers as well as copolymers of propylene and α-olefins with 2 to 18 carbon atoms as well as mixtures of said polypropylenes. Particularly preferred starting materials for these modified propylene polymers are polypropylene homopolymers, random propylene copolymers, propylene block copolymers and/or random propylene block copolymers.

Examples of these modified propylene polymers A), produced by free radical coupling reactions, are:

polypropylenes modified by the reaction of polypropylenes with bis-maleimido compounds in the melt (EP 574 801; EP 574804), polypropylenes modified by treatment of polypropylenes with multifunctional, ethylenically unsaturated monomers under the action of ionizing radiation (EP 678 527), polypropylenes modified by treatment of polypropylenes with multifunctional, ethylenically unsaturated monomers in the presence of peroxides in the melt (EP 688817, EP 450342).

The modified propylene polymers A), produced by polymer-like reactions, can be produced by the reaction of functionalized polypropylenes with multifunctional compounds of opposite reactivity.

Examples of propylene polymers A), modified by polymer-like reactions, are:

polypropylenes modified by the reaction of maleic anhydride-grafted polypropylene with diamines or polyglycols (EP 177401; JP 08 176 365), polypropylenes, modified by the reaction of polypropylenes, containing acid or acid anhydride groups, with polymers containing epoxy, hydroxy or amino groups (EP 307684; EP 299486).

The modified propylene polymers A) can also be prepared by the hydrolytic condensation of polypropylenes, which contain hydrolyzable silane groups. Examples of this are the products described in the DE patent 4107635 or the U.S. Pat. No. 4,714,716.

As modified propylene polymers A), which were synthesized by the treatment of propylene homopolymers and/or copolymers of propylene and ethylene or α-olefins with 4 to 18 carbon atoms as well as by the treatment of mixtures of said polypropylenes with multifunctional, ethylenically unsaturated monomers in the presence of thermally decomposing free radical-forming agents, which are to be used for the polyolefin fibers and polyolefin yarns and the textile fabrics produced therefrom, especially those modified propylene polymers are preferred, which have been prepared by a continuous method, in which 1) polypropylene particles, in the form of powders, granulates or grit with a preferred particle size ranging from 0.001 to 7 mm, which consist of 1.1) propylene homopolymers, particularly propylene homopolymers with a bimodal molecular weight distribution, a weight average molecular weight $M_w$ of 500,000 to 1,5000,000 g/mole, a number average molecular weight $M_n$ of 25,000 to 100,000 g/mole and $M_w/M_n$ values of 5 to 60, which were produced in a reactor cascade using Ziegler-Natta catalysts or metallocene catalysts, and/or from 1.2) copolymers of propylene and α-olefins with 2 to 18 carbon atoms, preferably of random propylene copolymers, propylene block copolymers, random propylene block copolymers and/or elastomeric polypropylenes, or of mixtures of said modified polypropylenes, are mixed in a continuous mixer with 0.05% to 3% by weight, based on the polypropylenes used, of acyl peroxides, alkyl peroxides, hydroperoxides, peroxycarbonates and/or peresters as thermally decomposing free radical-forming agents, the thermal decomposition preferably is concluded at a temperature below 210° C. and which optionally are diluted with inert solvents, with heating to 30° to 100° C. and preferably to 70° to 90° C., 2) readily volatile, bifunctional monomers, particularly $C_4$ to $C_{10}$ dienes and/or $C_7$ to $C_{10}$ divinyl compounds, are absorbed by the polypropylene particles from the gas phase, preferably in continuous flow-through mixers as continuous gas-solid absorbers, at a temperature T of 20° to 120 C.° and preferably of 60° to 100 C.° and an average absorption time $t_s$ of 10 seconds to 1,000 seconds and preferably of 60 seconds to 600 seconds, the proportion of bifunctional, unsaturated monomers in the polypropylene particles being 0.01% to 10% by weight and preferably 0.05% to 2% by weight, based on the polypropylenes used, subsequently 3) the polypropylene particles, in which the bifunctional, unsaturated monomers and, as thermally decomposition free radical-forming agents, the acyl peroxides, alkyl peroxides, hydroperoxides, peroxycarbonates and/or peresters are absorbed, are melted under an atmosphere of inert gas and these readily volatile, bifunctional monomers are melted at a temperature of 110° to 210° C. in continuous kneaders or extruders, preferably in twin-screw extruders and, at the same time, the thermally decomposing free radical-forming agents are decomposed, 4) the melt is thereupon heated to 220° C. to 300° C., unreacted monomers and decomposition products being removed, and 5) the melt is granulated in a known manner, and 0.01% to 2.5% by weight of stabilizers, 0.1% to 1% by weight of antistatic agents, 0.2% to 3% by weight of pigments, 0.05% to 1% by weight of nucleating agent and/or 0.01% to 5% by weight of processing aids, based on the polypropylene used, are added as further adjuvants before step 1) and/or step 5) of the method and/or before or during step 3) of the method and/or step 4).

The polypropylenes, used for the production of these preferred, modified propylene polymers A), consist especially of propylene homopolymers and/or copolymers of propylene and α-olefins with 2 to 18 carbon atoms, as well as of mixtures of said polypropylenes. Especially preferred are polypropylene particles of polypropylenes with a bimodal molecular weight distribution, which were synthesized in a reactor cascade using Ziegler-Natta catalysts or metallocene catalysts, with weight average molecular weights $M_w$ of 500,000 to 1,500,000 g/mole, number average molecular weights $M_n$ of 25,000 to 100,000 and $M_w/M_n$ values of 5 to 60 and preferably weight average molecular weights $M_w$ of 600,000 to 1,000,000 g/mole, number average molecular weights $M_n$ of 30,000 to 100,000 and $M_w/M_n$ values of 15 to 35.

Examples of the thermally decomposing free radical-forming agents, used for the synthesis of this preferred, modified polypropylene polymer A), are:

acyl peroxides, such as benzoyl peroxide, 4-chlorobenzoyl peroxide, 3-methoxybenzoyl peroxide and/or methyl benzoyl peroxide;

peroxides, such as allyl t-butyl peroxide, 2,2-bis(t-butylperoxybutane), 1,1-bis(t-butylperoxy)-3,3,5-trimethylcyclohexane, n-butyl-4,4-bis(t-butylperoxy) valerate, diisopropylaminomethyl-t-amyl peroxide, dimethylaminomethyl-t-amyl peroxide, diethylaminomethyl-t-butyl peroxide, dimethylaminomethyl-t-butyl peroxide, 1,1-di-(t-amylperoxy)cyclohexane, t-amyl peroxide, t-butylcumyl peroxide, t-butyl peroxide and/or 1-hydroxybutyl n-butyl peroxide;

peresters and peroxy carbonates, such as butyl peracetate, cumyl peracetate, cumyl perpropionate, cyclohexyl peracetate, di-t-butyl peradipate, di-t-butyl perazelate, di-t-butylperglutarate, di-t-butyl perthalate, di-t-butyl persebacate, 4-nitrocumyl perpropionate, 1-phenylethyl perbenzoate, phenylethyl nitro-perbenzoate, t-butylbicyclo-(2,2,1)heptane percarboxylate, t-butyl-4-carbomethoxy perbutyrate, t-butylcyclobutane percarboxylate, t-butylcyclohexyl peroxycarboxylate, t-butylcyclopentyl percarboxylate, t-butylcyclopropane percarboxylate, t-butyldimethyl percinnamate, t-butyl-2-(2,2-diphenylvinyl) perbenzoate, t-butyl-4-methoxy perbenzoate, t-butylperbenzoate, t-butylcarboxycyclohexane, t-butyl pernaphthoate, t-butyl peroxyisopropylcarbonate, t-butyl pertoluate, t-butyl-1-phenylcyclopropyl percarboxylate, t-butyl-2-propylperpentene-2-oate, t-butyl-1-methylcyclopropyl percarboxylate, t-butyl-4-nitrophenyl peracetate, t-butylnitrophenyl peroxycarbamate, t-butyl-N-succinimido percarboxylate, t-butyl percrotonate, t-butyl permaleic acid, t-butyl permethacrylate, t-butyl peroctoate, t-butyl peroxyisopropylcarbonate, t-butyl perisobutyrate, t-butyl peracrylate and/or t-butyl perpropionate;

Mixtures of these thermally decomposing free radical-forming agents can also be used to advantage for the synthesis of these preferred, modified propylene polymers A).

For the synthesis of these preferred, modified propylene polymers A), which optionally are contained in the inventive polyolefin fibers, polyolefin yarns and the textile fabrics produced therefrom, all bifunctional unsaturated monomeric compounds, which can be absorbed from the gas phase and can be polymerized with the help of free radicals, can be used as bifunctional unsaturated monomeric compounds. Preferably, the following bifunctional unsaturated monomers are used:

divinyl compounds, such as divinylaniline, m-divinylbenzene, p-divinylbenzene, divinylpentane and/or divinylpropane;

allyl compounds, such as allyl acrylate, allyl methacrylate, allyl methyl maleate and/or allyl vinyl ether;

dienes, such as butadiene, chloroprene, cyclohexadiene, cyclopentadiene, 2,3-dimethylbutadiene, heptadiene, hexadiene, isoprene and/or 1,4-pentadiene.

Advantageously, mixtures of these unsaturated monomers are also used for the synthesis of these preferred, modified propylene polymers A).

The absorption of these readily volatile, bifunctional unsaturated monomers takes place pursuant to the invention during the synthesis of these preferred modified propylene polymers A), particularly in continuous flow-through mixers as continuous solid absorbers of the gas.

For the synthesis of this preferred variation of the modified propylene polymers A), the heating and melting of the polypropylene particles, in which the bifunctional unsaturated monomers and the acyl peroxides, alkyl peroxides, hydroperoxides and/or peresters as thermally decomposing free radical-forming agents, are absorbed, is carried out under an atmosphere of readily volatile, bifunctional unsaturated monomers, preferably in continuously operating kneaders or extruders and especially in twin screw extruders.

The usual propylene polymers 1), contained as unmodified polypropylene polymers B) in the polyolefin fibers and polyolefin yarns and the textile fabric produced therefrom, consist preferably of propylene homopolymers with an $M_w/M_n$ ratio of 2 to 4.5 and/or of copolymers of propylene and α-olefins with 2 to 18 carbon atoms, as well as of mixtures of said polypropylenes.

The polyolefin mixture of crystalline copolymers and elastic copolymers, contained as unmodified polypropylene polymers B) in the polyolefin fibers and polyolefin yarns and the textile fabrics produced therefrom optionally as component 2), are, for example, the polymer mixtures described in EP 400333 or EP 472946.

The amorphous polypropylenes, contained as unmodified propylene polymers B) in the polyolefin fibers and polyolefin yarns and the textile fabrics produced therefrom as component 3) are, in particular, stereo block polypropylenes, which are synthesized, for example, using highly active metal oxide-fixed Ziegler-Natta catalysts (Collette, J., Macromolecules 22 (1989), 3851–3858, DE patent 2830160) or soluble Ziegler-Natta catalysts (de Candia, F., Makromol. Chem. 189 (1988), 815–821), optionally with subsequent reactivity modification (EP 636863) and/or degradation (EP 640 850).

The non-isotactic propylene homopolymers, optionally contained as non-modified propylene polymers B) in the polyolefin fibers and polyolefin yarns and textile fabrics produced therefrom as component 4) are, in particular, elastomeric, high molecular weight propylene homopolymers, for example, the products described in EP 475 307 or EP 475 308.

Especially preferred as unmodified propylene polymers B) in the polyolefin fibers and polyolefin yarns and the textile fabrics produced therefrom are polyolefin mixtures, which simultaneously contain several of the unmodified polyolefin components 1) to 4).

The adjuvants, contained in the polyolefin fibers and polyolefin yarns of high strength and elongation and in the textile fabrics produced therefrom, preferably are 0.01% to 2.5% by weight of stabilizers, 0.1% to 1% by weight of antistatic agents, 0.2% to 0.3% by weight of pigments, 0.05% to 1% by weight of nucleating agents and/or 0.1% to 1% by weight of processing aids. These adjuvants may already be contained in components A) and/or B) used in the melt processing or added additionally to these components.

As stabilizers, preferably mixtures of 0.01% to 0.6% by weight of phenolic antioxidants, 0.01% to 0.6% by weight of 3-arylbenzofiranones, 0.01% to 0.6% by weight of processing stabilizers based on phosphides, 0.01% to 0.6% by weight of high temperature stabilizers based on disulfides and thioethers and/or 0.01% to 0.8% by weight of sterically hindered amines (HALS) are used.

Suitable phenolic antioxidants are 2-t-butyl-4,6-dimethylphenol, 2,6-di-t-butyl-4-methylphenol, 2,6-di-t-butyl-4-isoamylphenol, 2,6-di-t-butyl-4-ethylphenol, 2-t-butyl-4,6-diisopropylphenol, 2,6-dicyclopentyl-4-methylphenol, 2,6-di-t-butyl-4-methoxymethylphenol, 2-t-butyl-4,6-dioctadecylphenol, 2,5-di-t-butylhydroquinone, 2,6-di-t-butyl-4,4-hexadecyloxyphenol, 2,2'-methylene-bis(6-t-butyl-4-methylphenol), 4,4'-thio-bis-(6-t-butyl-2-methylphenol), octadecyl 3(3,5-di-t-butyl-4-hydroxyphenyl) propionate, 1,3,5-trimethyl-2,4,6-tris(3'-5'-di-t-butyl-4-hydroxybenzyl)benzene and/or pentaerythritol-tetrakis(3-(3,5-di-t-butyl-4-hydroxyphenyl)) propionate.

As benzofuranone derivative, 5,7-di-t-butyl-3-(3,4-dimethylphenyl)-3H-benzofuran-2-one, in particular, is suitable.

As HALS compounds, bis-2,2,6,6-tetramethyl-4-piperidyl sebacate and/or poly-((1,1,3,3,-tetramethylbutyl)-imino)-1,3,5-triazine-2,4,diyl)(2,2,6,6-tetra-methyl-piperidiyl)-amino)-hexamethylene-4-(2,2,6,6-tetramethyl) piperidyl)-imino) are particularly suitable.

As processing aids, calcium stearate, magnesium stearate and/or waxes can be used.

The polyolefin fibers and polyolefin yarns of high strength and elongation, in particular, polyolefin fibers and polyolefin yarns, which have not been afterstretched and have capillary titers of 1 to 10 dtex and tensile elongations greater than 130% at tensile strengths of at least 15 cN/tex, and the textile fabrics produced therefrom, are produced according to one method by processing polypropylene mixtures in known melt spinning plants comprising plasticizing extruder, extrusion pump, melt distributor, spinnerets, blast shaft and downstream equipment with the process steps of melting at mass temperatures of 185° to 310° C., transferring the melt to the spinnerets by means of a melt pump, extrusion in the blast shaft, drawing off as filaments and further processing in downstream equipment, pursuant to the invention either polypropylene mixtures are used which, on the one hand, are prepared from A) 0.05% to 10% by weight and preferably 0.2% to 3% by weight of modified propylene polymers with melt indexes of 0.1 to 50 g/10 min at 230° C./2.16 kg and preferably of 1 to 40 g/10 min at 230° C./2.16 kg and a ratio of the intrinsic viscosity of the modified polypropylene to the intrinsic viscosity of the unmodified polypropylene of largely the same weight average molecular weight of 0.20 to 0.95, which a) were prepared by the treatment of propylene homopolymers and/or copolymers of propylene and ethylene or α-olefins of 4 to 18 carbon atoms, as well as by the treatment of mixtures of said polypropylenes with multifunctional, ethylenically unsaturated monomers in the presence of ionizing radiation or thermally decomposing free radical-forming agents or b) by the reaction of functionalized polypropylenes, preferably of polypropylenes containing acid groups and/or acid anhydride groups, with multifunctional compounds of opposite reactivity, preferably with $C_2$ to $C_{16}$ diamines and/or $C_2$ to $C_{16}$ diols or c) by hydrolytic condensation of polypropylenes, which contain hydrolyzable silane groups, and, on the other, consist of B) 99.95% to 90% by weight and preferably 99.8% to 97% by weight of unmodified propylene polymers, the unmodified propylene polymers consisting of 1) conventional propylene polymers, preferably propylene homopolymers synthesized using Ziegler-Natta catalysts or metallocene catalysts, and/or copolymers of propylene, ethylene and/or α-olefins with 4 to 18 carbon atoms with a propylene content of 80.0% to 99.9% by weight in the form of random copolymers, block copolymers and/or random block copolymers with melt indexes of 0.1 to 300 g/10 min at 230° C./2.16 kg and preferably of 1 to 100 g/10 min at 230° C./2.16 kg, which may be contained in the polypropylene mixtures for producing the polyolefin fibers and polyolefin yarns and the textile fabrics produced therefrom in amounts up to 99% by weight and preferably of 99% to 50% by weight, and/or 2) a polyolefin mixture with an $M_w/M_n$ ratio of 2 to 6 and a melt index of 1 to 40 g/10 min at 230° C./2.16 kg, which consists of 2.1) 60% to 98% by weight of a crystalline copolymer of 85% to 99.5% by weight of propylene and 15% to 0.5% by weight of ethylene and/or an α-olefin of the general formula $CH_2{=}CHR$, wherein R is a linear or branched alkyl group with 2 to 8 carbon atoms, 2.2) 2% to 40% by weight of an elastic copolymer of 20% to 70% by weight of ethylene and 80% to 30% by weight of propylene and/or an α-olefin of the general formula $CH_2{=}CHR$, wherein R is a linear or branched alkyl group with 2 to 8 carbon atoms, whereby the polyolefin mixture may be contained in the polypropylene mixtures for producing polyolefin fibers and polyolefin yarns and the textile fabrics produced therefrom in amounts up to 99% by weight and preferably of 10% to 80% by weight, and/or 3) largely amorphous polypropylenes or propylene copolymers with a crystalline portion in the polypropylene or crystalline propylene copolymer of less than 10% by weight, and a heat of fusion of less than 40 J/g and a melt index of 0.1 to 100 g/10 min at 230° C./2.16 kg, the largely amorphous polypropylene being a homopolymer of propylene and/or a copolymer of propylene of at least 80 mole percent propylene and not more than 20 mole percent of one or more α-olefins of the general formula $CH_2{=}CHR$, wherein R is a linear or branched alkyl group with 2 to 8 carbon atoms, which may be contained in the polypropylene mixtures for producing polyolefin fibers and polyolefin yarns and textile fabrics produced therefrom in amounts of 50% by weight, and/or 4) nonisotactic propylene homopolymers with a melting point of 145° to 165° C., a melt viscosity in excess of 200,000 cps at 190° C., a heat of crystallization of 4 to 10 cal/g and a 35% to 55% by weight portion soluble in diethyl ether, which may be contained in the polypropylene mixtures for producing polyolefin fibers and polyolefin yarns and textile fabrics produced therefrom in amounts up to 50% by weight, or polypropylene mixtures are used, which consist only of unmodified propylene polymers B), the components 3) and/or 4) being contained in amounts of 5% to 50% by weight and the remaining components being contained in amounts of 95% to 50% by weight in the polypropylene mixtures for the production of polyolefin fibers and polyolefin yarns and the textile fabrics produced therefrom, and, furthermore, 0.01% to 5% by weight of adjuvants, based on the polyolefins, optionally being added to the polypropylene mixtures for the production of polyolefin fibers and polyolefin yarns and textile fabrics produced therefrom.

As plasticizing extruder for melting the mixtures, especially single screw extruders or twin screw extruders with screw length of 28 to 30 D, preferably with flange-mounted static or dynamic mixers, are suitable. Shear speeds can be adjusted to values of $10^2$/sec to $10^3$/sec by controlling the temperature and the rpm.

For uniformly metering the mixture, which has been melted in the plasticizing extruder, over the melt distributor to the capillary die, melt pumps, preferably heated with diphenyl, are used for the melts heated to 240° to 310° C.

For producing staple fibers from the polypropylene mixtures, the fibers, pursuant to the invention, are drawn off with the help of high-speed galettes and processed further in downstream equipment consisting of a drawing unit, a crimper, a fixing unit and a cutting machine by drawing, crimping and cutting, filament speeds being adjusted to values of 60 to 250 m/min in abbreviated spinning equipment (slow spinning) with 2,000 to 70,000 spinneret holes per die and to values of 350 to 4,000 m/min in long spinning equipment (conventional high-speed spinning equipment) with 800 to 3,500 spinneret holes per die.

In abbreviated spinning equipment, crimping takes place in a stuffer box, and in long spinning equipment, it takes place over crimpers, the crimping being two dimensional.

The long spinning equipment, which preferably is suitable for finer titers, the processing of the polypropylene mixtures into fibers and the further processing into staple yarns in the drawing line as downstream equipment are separate processes. The extruded filaments initially are combined into fiber cables and deposited in cans, before further processing takes place in the drawing line.

For the production of three-dimensionally crimped yarn of the "bulked continuous filament" type with titers of 300 to 4,000 dtex, the fibers of the polypropylene mixtures, pursuant to the invention, are drawn off with the help of high-speed galettes and processed further in downstream equipment consisting of the drawing unit, the hot-air texturizing chamber, relaxing equipment, tangling equipment and winder by drawing, hot-air texturizing, crimping and entangling at yarn drawing-off speeds of 1,000 to 4,000 m/min. The entangling makes a separate twisting process unnecessary.

For producing high tenacity filament yarns of the "fully drawn yarn" type with tenacity values of 10 cN/dtex, total titers of 40 to 3,000 dtex and capillary titers of 3 to 14 dtex, the yarns, drawn off from the polypropylene mixtures pursuant to the invention with the help of high-speed galettes, are processed further in downstream equipment consisting of drawing equipment and winders, the yarn drawing-off speeds being adjusted to 60 to 450 m/min in abbreviated spinning equipment and to 350 to 4,000 m/min in long spinning equipment.

For producing multifilament yarns, the filaments from the polypropylene mixtures are processed further, pursuant to the invention, in downstream equipment comprising cable-forming equipment and winders.

Filament yarns of the pre-oriented yarn type with capillary titers of 2 to 6 dtex and total titers of 500 dtex are produced pursuant to the invention by processing fibers from the polypropylene mixtures further in downstream equipment comprising a guiding system and winders and, optionally, interposed galettes at filament pull-off speeds of 1,000 to 5,000 m/min.

Textile fabrics in the form of nonwoven fabrics are produced, pursuant to the invention, after the filaments are drawn off from the polypropylene mixtures in the blast shaft by means of air by processing the filaments further into spunbonded nonwoven material in downstream equipment, comprising screen conveyor belt, calender or needling equipment and winder, by the planar, disordered deposition of the fibers on the screen-shaped conveyor belt and applying thermal bonding or needling processes to achieve the required strength and dimensional stability. Compared to nonwoven fabrics made from staple fibers, these spunbonded nonwoven materials have a significantly more advantageous longitudinal to transverse strength relationship.

A special variation of the manufacture of nonwoven materials is formed, pursuant to the invention, by the application of a high-temperature air stream about the capillary die openings during the extrusion of the filaments from the polypropylene mixtures from the capillary die in the blast shaft. The stream of air draws the molten filaments from the polyolefin mixture, simultaneously dividing them into many individuals fibriles with fiber diameters of 0.5 to 12 $\mu$m. The fibers, deposited on the screen conveyor belt, are processed further as in the case of spunbonded material. Of particular importance for this melt blast variation of producing nonwoven fabrics from the polyolefin mixtures is the temperature profile and the shear velocity profile of the melt processing equipment, which must be adjusted so that the melt is subjected to a degradative viscosity lowering to a melt index in excess of 150 g/10 min at 230° C./2.16 kg.

DETAILED DESCRIPTION OF PREFERRED EMBODIMENTS OF THE INVENTION

Figure 1:
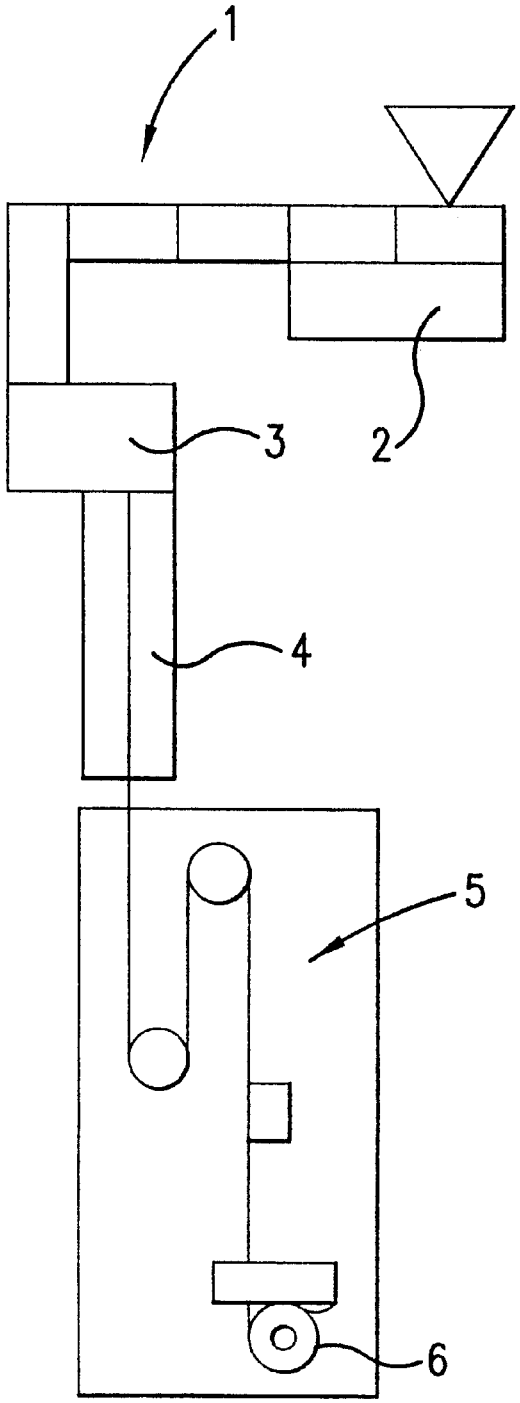
FIG. 1 (referred to hereinbelow as "Drawing 1") is a schematic diagram of apparatus for carrying out the method of the invention.

For the production of polyolefin fibers and polyolefin yarns, which are not drawn subsequently, the inventive method is explained, by way of example, by a method outlined in Drawing 1. The reference symbols have the following meaning:

1. extruder
2. extrusion pump
3. spinneret
4. blast shaft
5. pull-off equipment
6. winder As extruder (1) for melting the polyolefin mixtures, preferably a single screw extruder is used with a high homogenizing effect with screw length of 28 to 36 D, preferably with flange-mounted static or dynamic mixers.

Preferably, the spinnerets (3) have internal diameters of 0.35 to 1.5 mm.

In the pull-off equipment (5), the pulling-off can be accomplished directly by means of the winders (6) or with the interposing of high-speed galettes. Preferred pull-off speeds for capillary titers of 2.5 to 5 dtex are 2,500 to 3,500 m/min.

Preferred areas of use for the inventive polyolefin fibers, polyolefin yarns and the textile fabrics produced therefrom are:

- multilayered textiles, preferably in combination with natural fibers, with a high degree of wearing comfort and heat retention capability, especially for knitwear, sports and leisure clothing,
- knitwear with a high heat retention capability,
- high strength technical fabrics of high abrasion resistance and dimensional stability in the wet state, preferably in the form of cordage, belts and filter fabrics, textiles for the home, such as easy care wall-to-wall carpeting, which develops little electrostatic charge, as well as upholstery fabrics, especially for garden furniture,
- nonwoven materials in the medicine and hygiene areas, such as operating-room gowns and diaper coverings,
- Nonwoven geotextiles for street and railroad construction and for building site fixtures,
- nonwoven tapes for eliminating oil spills at sea,
- elastic hygiene articles.

The invention is explained by means of the following examples:

EXAMPLE 1

In spinning equipment of FIG. 1, a polyolefin mixture, which consists of 99% by weight of an unmodified polypropylene homopolymer (melt index of 18.2 g/10 minutes at 230° C./2.16 kg), 1% by weight of a modified polypropylene (melt index of 5.5 g/10 min at 230° C./2.16 kg), a ratio of the intrinsic viscosity (in decalin at 135° C.) of the modified polypropylene to that of the unmodified polypropylene with largely identical weight average molecular weights of 0.74), 0.25% by weight of 2-t-butyl-4,6-diisopropylphenol, 0.2% by weight of bis-2,2,6,6-tetramethyl-4-piperidyl sebacate and 0.2% by weight of calcium stearate (the percentages of adjuvants are, in each case, based on the sum of the propylene polymers), is melted in the extruder at a mass temperature of 275° C. The melt is transferred by the extrusion pump to the spinnerets and, at a spinneret temperature of 292° C., drawn off through the blast shaft, which is cooled with compressed air at a temperature of 20° C., at a speed of 3000 m/min by high-speed galettes and wound up.

The resulting polypropylene yarn, which is not drawn, has a total titer of 252 dtex, a tensile strength of 19.5 cN/tex and a tensile elongation of 202%.

EXAMPLE 2

In spinning equipment of FIG. 1, a polyolefin mixture, which consists of 89% by weight of an unmodified polypropylene homopolymer (melt index of 18.2 g/10 minutes at 230° C./2.16 kg), 10% by weight of an unmodified heterophasic, random propylene-ethylene block copolymer (with an ethylene content of 33 mole percent and a melt index of 8 g/10 min at 230° C./2.16 kg), 1% by weight of a modified polypropylene (with a melt index of 5.5 g/10 min at 230° C./2.15 kg, a ratio of the intrinsic viscosity (in decalin at 135° C.) of the modified polypropylene to that of the unmodified polypropylene with a largely identical weight average molecular weight of 0.74), 0.25% by weight of 2-t-butyl-4,6-diisopropylphenol, 0.25% by weight of bis-2,2,6,6-tetramethyl-4-piperidyl sebacate and 0.1% by weight of magnesium stearate (the percentages of adjuvants are, in each case, based on the sum of the propylene polymers), is melted in the extruder at a mass temperature of 275° C. The melt is transferred by the extrusion pump to the spinnerets and, at a spinneret temperature of 275° C., drawn off through the blast shaft, which is cooled with compressed air at a temperature of 20° C., at a speed of 3,000 m/min by high-speed galettes and wound up.

The resulting polypropylene yarn, which is not drawn, has a total titer of 253 dtex, a tensile strength of 18.5 cN/tex and a tensile elongation of 195%.

EXAMPLE 3

COMPARATIVE EXAMPLE

In spinning equipment of FIG. 1, a polypropylene compound, which consists of 100% by weight of an unmodified polypropylene homopolymer (melt index of 18.2 g/10 minutes at 230° C./2.16 kg), 0.2% by weight of pentaerythritol tetrakis(3-(3,5-di-t-butyl-4-hydroxyphenyl)) propionate, 0.2% by weight of bis-2,2,6,6-tetramethyl-4-piperidyl sebacate and 0.2% by weight of magnesium stearate (the percentages of adjuvants are, in each case, based on the propylene homopolymers), is melted in the extruder at a mass temperature of 280° C. The melt is transferred by the extrusion pump to the spinnerets and, at a spinneret temperature of 290° C., drawn off through the blast shaft, which is cooled with compressed air at a temperature of 20° C., at a speed of 3,000 m/min by high-speed galettes and wound up.

The resulting polypropylene yarn, which is not drawn, has a total titer of 254 dtex, a tensile strength of 23.7 cN/tex and a tensile elongation of 124%.

EXAMPLE 4

Preparation of Modified Propylene Polymers

A powdery polypropylene homopolymer (with a melt index of 0.2 g/10 min at 230° C./2.16 kg and an average particle diameter of 0.55 mm) is metered continuously into a continuous heatable mixer. Furthermore, 0.1% by weight of calcium stearate and 0.09% by weight of bis(t-butylperoxy)-2,5-dimethylhexane, each based on the polypropylene homopolymer, are metered in continuously. While being mixed homogeneously at 45° C., the polypropylene homopolymer, containing the thermally decomposing free radical-forming agent and adjuvant, absorbs 1.1% by weight of butadiene, based on the polypropylene homopolymer, by being treated at a residence time of 6 minutes at 45° C. with a butadiene-nitrogen mixture. After being transferred to a twin screw extruder, the powdery reaction mixture, in contact with the butadiene-nitrogen mixture metered in and with addition of 0.1% by weight of Irganox 1010 and 0.1% by weight of Irgaphos 168, is melted at a mass temperature of 235° C. and, after a rough degassing, during which water is metered in as entraining agent, is subjected to a final degassing, discharged and granulated.

The resulting, modified polypropylene has a bound butadiene content, determined by IR, of 1.0% by weight and a melt index of 0.85 g/10 min at 230° C./2.16 kg.

Processing the Polyolefin Mixture:

In laboratory spinning equipment, comprising a plasticizing extruder, an extrusion pump, a capillary die, a blast shaft, pull-off equipment and a winder, a polypropylene mixture, which consists of 99% by weight of a polypropylene homopolymer (with a melt index of 18.2 g/10 min at 230° C./2.16 kg), 1% by weight of a modified polypropylene (with a melt index of 0.85 g/10 min at 230° C./2.16 kg and containing 1.0% by weight of bound butadiene), 0.25% by weight of 2-t-butyl-4,6-diisopropylphenol, 0.2% by weight of bis-2,2,6,6-tetramethyl-4-piperidyl sebacate and 0.2% by weight of calcium stearate (the percentage of adjuvants is based in each case on the sum of the propylene polymers) is melted in the extruder at a mass temperature of 272° C. The melt is transferred with the extrusion pump to the spinnerets and, with the spinnerets at a temperature of 290° C., drawn off through the blast shaft, which is cooled with compressed air to a temperature of 200° C., with a pull-off speed of 3,000 m/min by high-speed galettes and wound up.

The resulting filament yarn of the "pre-orientated yarn" type has a total titer of 252 dtex, a tensile strength of 19.5 cN/tex and a tensile elongation of 202%.

EXAMPLE 5

COMPARISON EXAMPLE

In laboratory spinning equipment of Example 1, a polypropylene compound, which consisted of 100% by weight of an unmodified polypropylene homopolymer (with a melt index of 18.2 g/10 min at 230° C./2.16 kg), 0.2% by weight of pentaerythritol tetrakis(3-(3,5-di-t-butyl-4-hydroxyphenyl)) propionate, 0.2% by weight of bis-2,2,6,6-tetramethyl-4-piperidyl sebacate and 0.2% by weight of magnesium stearate (the percentages of the adjuvants are in each case related to the polypropylene homopolymer) are melted in the plasticizing extruder at a mass temperature of 275° C. The melt is transferred with the melt pump to the spinnerets and, with the spinnerets at a temperature of 290° C., drawn off at a rate of 3,000 m/min by high-speed galettes through the blast shaft, which is cooled with compressed air having a temperature of 20° C.

The resulting filament yarn of the "pre-oriented yarn" type has a total titer of 254 dtex, a tensile strength of 23.7 cN/tex and a tensile elongation of 124%.

EXAMPLE 6

Preparation of the Modified Propylene Polymers

A powdery, random polypropylene copolymer (with a melt index of 0.85 g/10 min at 230° C./2.16 kg and a particle diameter of 0.85 mm) is added continuously to a continuous mixer, which can be heated. Furthermore, 0.05% by weight of hydrotalcit, 0.05% by weight of calcium stearate and 0.45% by weight of t-butyl peroxybenzoate, in each case based upon the amount of polypropylene copolymer, are added continuously to the continuous mixer. While being mixed homogeneously at 70° C., the polypropylene homopolymer, charged with the thermally decomposing free radical-forming agent and adjuvant, absorbs 3.5% by weight of divinylbenzene, based on the polypropylene homopolymer, from the inflowing divinylbenzene-nitrogen mixture during a contact time of 4 minutes. After being transferred to the twin screw extruder, the powdery reaction mixture, in contact with the divinylbenzene-nitrogen mixture that has been supplied, is melted with the addition of 0.1% by weight of Irganox 1010 and 0.1% by weight of Irgaphos 168 at a mass temperature of 225° C. and, after a rough degassing, during which water is metered in as entraining agent, is subjected to a final degassing, discharged and granulated.

The resulting modified polypropylene copolymer contains 0.32% by weight of bound divinylbenzene, as determined by IR spectroscopy, and has a melt index of 1.35 g/10 min at 230° C./2.16 kg.

Processing of the Polyolefin Mixture:

In high-speed laboratory spinning equipment, comprising a plasticizing extruder, melt pump, capillary die, blast shaft, pull-off equipment and can, a polypropylene mixture, which consists of 89% by weight of a polypropylene homopolymer (with a melt index of 18.2 g/10 min at 230° C./2.16 kg), 10% by weight of a reactor blend (with an ethylene content of 33 mole percent and a melt index of 8 g/10 min at 230° C./2.16 kg), consisting of a crystalline polypropylene-ethylene copolymer and an elastic ethylene-propylene copolymer, 1% by weight of a modified polypropylene (containing 0.32% by weight of bound divinylbenzene and having a melt index of 1.35 g/10 min at 230° C./2.16 kg), 0.25% by weight of 2-t-butyl-4,6-diisopropylphenol, 0.25% by weight of bis-2,2,6,6-tetramethyl-4-piperidyl sebacate and 0.1% by weight of magnesium stearate (the percentage of adjuvant is in each case based on the sum of the propylene polymers), is melted in the extruder at a mass temperature of 280° C. The melt is transferred with the melt pump to the spinnerets and with the spinnerets at a temperature of 285° C. drawn off at a rate of 3,000 m/min by high-speed galettes through the blast shaft, which is cooled with compressed air having a temperature of 20° C.

For the discontinuous production of staple fibers, the deposited polypropylene yarn, is subjected in a laboratory processing line comprising a drawing unit, a crimper and a cutting machine, to 850% drawing and a two-dimensional crimping and cut into segments. A sample (with a yarn diameter of 0.2 mm), which has not been crimped and taken after the drawing unit, has a tensile strength of 540 MPa and a elongation of 46%.

The fiber segments are processed further on a laboratory calender by thermal bonding into a nonwoven material, which has a mass per unit area of 60 g/m$^2$ and a ratio of longitudinal strength to transverse strength of 2.6:1.

What is claimed is:

1. A method for producing polyolefin fibers of high strength and elongation by processing a polypropylene, the method comprising the steps of:

a), mixing polypropylene particles in a continuous mixer with about 0.05% to 3% by weight of a free radical-forming agent, based on an amount of the polypropylene particles used;

b) adding a bifunctional monomer to the polypropylene particles of step a) from a gas phase at a temperature of about 20° to 120° C. and an average absorption time $t_s$ of about 10 seconds to 1,000 seconds wherein a proportion of the bifunctional monomer in the polypropylene particles being about 0.001% to 10% by weight, based on an amount of the polypropylenes particles used;

c) melting the polypropylene particles of step b) under an atmosphere of inert gas at a temperature of about 110° to 210° C. to form a melt;

d) heating the melt step c) to about 220° C. to 300° C. wherein unreacted monomer and decomposition products are removed;

e) granulating the melt; and f) forming said polyolefin fibers from the granulate.

2. A method for producing polyolefin fibers of high strength and elongation according to claim 1 in which the forming of the polyolefin fibers is effected in melt spinning equipment including a plasticizing extruder, an extrusion pump, a melt distributor, a plurality of spinnerets, a blast shaft, and downstream equipment, the method further comprising the steps of:

a) melting the polypropylene granulate at a temperature of about 185° to 310° C. to form a melt;

b) transferring the melt of step a) to the spinnerets by use of the melt pump;

c) extruding the melt of step b) in the blast shaft;

d) drawing off the melt of step c) as filaments; and e) further processing the filaments of step d) in the downstream equipment.

3. The method according to claim 2, wherein the filaments are pulled off with high-speed galettes and further processed by:

A) processing by drawing, crimping, and cutting into staple fibers wherein filament pull-off speeds being adjusted in abbreviated spinning equipment to values of about 60 to 250 m/mm and, in long spinning equipment to filament pull-off speeds of about 350 to 4,000 m/mm, in downstream equipment comprising a drawing unit, a crimper, a fixing unit, and a cutting machine; or B) processing into three-dimensional crimped yarns by drawing, hot-air texturizing, crimping and tangling wherein filament pull-off speeds being adjusted to about 1,000 to 4,000 m/mm, in downstream equipment, comprising a drawing unit, a texturizing equipment, a relaxing equipment, a tangling equipment, and a winder; or C) processing by drawing into high strength filament yarns of a "fully drawn yarn" type wherein filament pull-off speeds being adjusted to values of about 60 to 450 m/mm in abbreviated spinning equipment and to values of about 350 to 4,000 m/min in long spinning equipment, in downstream equipment comprising a drawing unit and a winder; or D) processing into multifilament yarns, in downstream equipment comprising cable-forming equipment and winders.

4. The method according to claim 3, wherein the downstream equipment has a guiding system and winders with filament pull-off speeds being adjusted to values of about 1,000 to 5,000 m/min.

* * * * *